US008615910B2

(12) United States Patent
Glass et al.

(10) Patent No.: US 8,615,910 B2
(45) Date of Patent: Dec. 31, 2013

(54) POP-UP GIFT CARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 52 days.

(21) Appl. No.: 13/430,676

(22) Filed: Mar. 26, 2012

(65) Prior Publication Data

US 2013/0067780 A1 Mar. 21, 2013

Related U.S. Application Data

(60) Provisional application No. 61/467,475, filed on Mar. 25, 2011.

(51) Int. Cl.

| | |
|---|---|
| ***B65D 73/00*** | (2006.01) |
| ***B31B 1/26*** | (2006.01) |
| ***G09F 1/00*** | (2006.01) |

(52) U.S. Cl.
USPC ..... 40/124.08; 40/124.14; 206/768; 206/449

(58) Field of Classification Search
USPC ..... 40/124.08, 124.14, 539, 610, 611.06; 446/148, 487, 488
See application file for complete search history.

(56) References Cited

U.S. PATENT DOCUMENTS

| | | | | |
|---|---|---|---|---|
| 930,108 | A * | 8/1909 | Walcutt | 446/148 |
| 3,234,682 | A | 2/1966 | Frankl | |
| 3,995,388 | A * | 12/1976 | Penick et al. | 40/530 |
| 4,763,427 | A | 8/1988 | Schrager | |
| 5,983,538 | A | 11/1999 | Crowell | |
| 6,418,648 | B1 * | 7/2002 | Hollingsworth et al. | 40/124.14 |
| 6,966,135 | B1 * | 11/2005 | McDonald | 40/124.08 |
| 7,938,270 | B2 * | 5/2011 | Davis | 206/768 |
| 8,474,619 | B1 * | 7/2013 | Chrisman | 206/449 |
| 2003/0150142 | A1 | 8/2003 | Street | |
| 2005/0258060 | A1 * | 11/2005 | Katz | 206/425 |
| 2007/0169388 | A1 * | 7/2007 | Malkovas | 40/124.08 |
| 2010/0043262 | A1 | 2/2010 | O'Brien | |

OTHER PUBLICATIONS

Office Action dated Aug. 16, 2013 to U.S. Appl. No. 13/294,150.
Office Action dated Mar. 19, 2013 to U.S. Appl. No. 13/294,150.

* cited by examiner

*Primary Examiner* — Casandra Davis
(74) *Attorney, Agent, or Firm* — Polsinelli PC

(57) ABSTRACT

A holder for receiving and holding a gift card includes one or more pop-up elements that project upward from the inner surfaces of the main body of the holder. When presented for sale, a backer panel bearing a removeably attached gift card projects from the holder and is separable from the holder post-sale by tearing or cutting along perforation line therebetween. The gift card is removed from the backer panel and installed upon a pop-element inside in the holder, the holder is secured in a closed position and the holder is presented to the gift recipient.

4 Claims, 4 Drawing Sheets

POP-UP GIFT CARD HOLDER

CROSS REFERENCE TO RELATED APPLICATIONS

This application claims the benefit of the prior filed, provisional application Ser. No. 61/467,475, filed Mar. 25, 2011.

BACKGROUND OF THE INVENTION

This invention relates generally to card holders and more particularly to a device for holding a transaction card, such as a gift card, in a pop-up element to enhance the presentation of the gift card to a gift recipient.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

What is needed, therefore, is a gift card holder that provides graphical and mechanical enhancements to entertain the gift card recipient and add value to the gift.

BRIEF DESCRIPTION OF THE INVENTION

The purpose of this invention is to provide a holder for receiving and holding a gift card. The holder includes one or more pop-up elements that project upward from the inner surfaces of the main body of the holder. In some embodiments, the holder is presented for sale with a gift card attached to a backer panel. Prior to gifting, the gift card is removed from the backer panel and installed upon a pop-element inside in the holder, the holder is secured in a closed position and the holder is presented to the gift recipient.

A pop-up transaction card holder may include a main body having at least one cover flap and a popup element positioned underneath the cover flap when the holder is in a closed position. The popup element may include a first panel projecting from the inner surface of the cover flap and a second panel projecting from a main panel hingedly connected to the cover flap. A first side panel extends from the first panel to connect at a first fold line with a second side panel extending from an opposing side of the second panel, and a first slot extends downward along the first fold line. A third side panel extends from the first panel to connect at a second fold line with a fourth side panel extending from an opposing side of the second panel, and a second slot extends downward along the second fold line. The slots are sized to receive and hold within each slot a portion a transaction card. The transaction card holder may further include a hang tag assembly extending from the main body and a perforation line dividing the hang tag assembly from the main body. The hang tag assembly may include a transaction card backer panel attached to a hang tag panel of the assembly.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
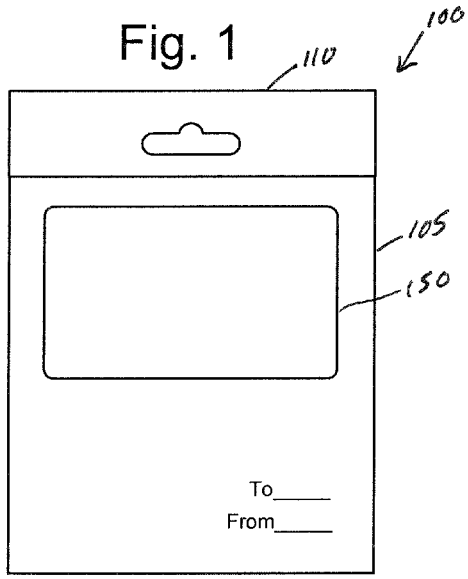
FIG. 1 is a front view of a gift card holder including a gift card backer panel attached to and suspended from a hang tag assembly.
Figure 2:
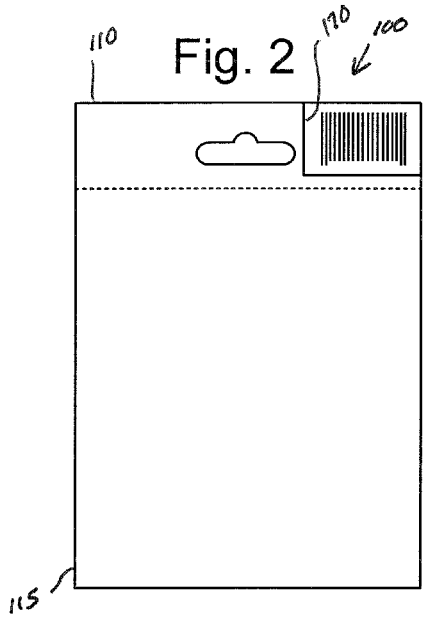
FIG. 2 is a rear view of a gift card holder including a main body of the holder attached to and suspended from a hang tag assembly.

With reference to the figures, FIGS. 1 through 9 illustrate an embodiment of a gift card holder 100. FIG. 1 is a front view of a gift card holder 100 including a gift card backer panel 105 attached to and suspended from a hang tag assembly 110. FIG. 2 is a rear view of the gift card holder 100 including a main body 115 of the holder attached to and suspended from the hang tag assembly 110. The main body 115 may comprise a structure with one or more cover flaps, similar to a greeting card. The illustrated embodiment of a main body 115 comprises a bifold structure with a first cover flap 120, and overlying second cover flap 125, and a main panel 130 therebetween such that the first cover flap 120 and second cover flap 125 are connected to the main panel 130 along fold lines 135*a* and 135*b*, respectively (see FIGS. 3 and 5). The flaps 120 and 125 and main panel 130 typically include decorations, graphics and/or text upon surfaces that may be viewed when the holder 100 is in use or displayed for sale.

The hang tag assembly 110 includes a first hang tag panel 112 that projects from or is attached to the main panel 130 of the main body 115. In the embodiments illustrated in FIGS. 1-5, the first hang tag panel 112 is integral with the main panel 130 (formed from the same sheet of card stock or the like) with a fold line formed by a line of perforations 140 running therebetween. A second hang tag panel 114 projects from the end of the first hang tag panel 112 that opposes the main panel 130. A fold line 116 distinguishes or separates the second hang tag panel 114 from the first hang tag panel 112. A display peg hole 118, such as a sombrero-cut hole shown in the figures, is provided in each of the hang tag panels 112 and 114 so that the holes 118 are in alignment when the second hang tag panel 114 is folded over the first hang tag panel 112, as shown in FIGS. 1, 2 and 4.

Figure 4:
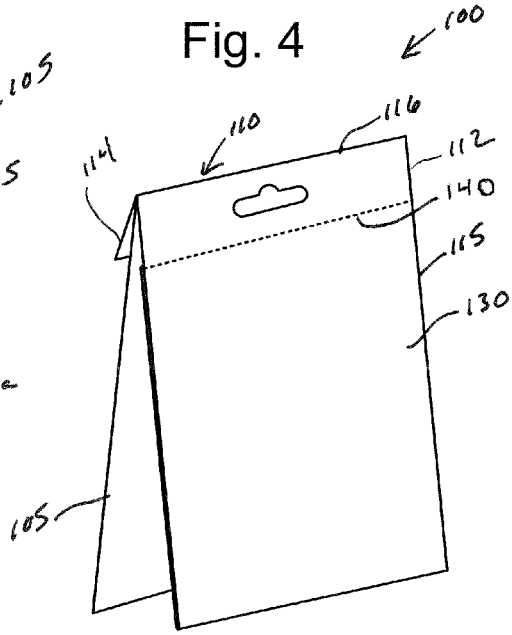
FIG. 4 is a rear perspective view of a gift card holder.

During assembly of the holder 100, the backer panel 105 is inserted between the first and second hang tag panels 112 and 114, as shown in FIG. 4. Adhesive on the interior surfaces of the hang tag panels 112 and 114 adheres the backer panel 105 therebetween. A hang tag assembly 110 is thereby formed bearing a backer panel 105 and which is separable from the main body 115 of the holder 100 by cutting or tearing along perforation line 140. As shown in FIG. 1, the backer panel 105 bears or carries a removably attached transaction card, such as a gift card 150. Typically, the gift card 150 is adhered to the front surface (or alternatively the rear surface) of the backer panel 105 using removable adhesive as known in the prior art. Prior art backer panels 105 may be used in the present invention or may be constructed from card stock or the like specifically for such use.

Prior to presenting the gift card holder 100 to a recipient, the hang tag assembly 110 (including backer panel 105) is typically removed from the gift card holder 100 by tearing along the perforation line 140 that separates the hang tag assembly 110 from the main panel 130. The gift card 150 is also removed from the backer panel 105 and installed within or upon the gift card holder 100 as described below.

Figure 3:
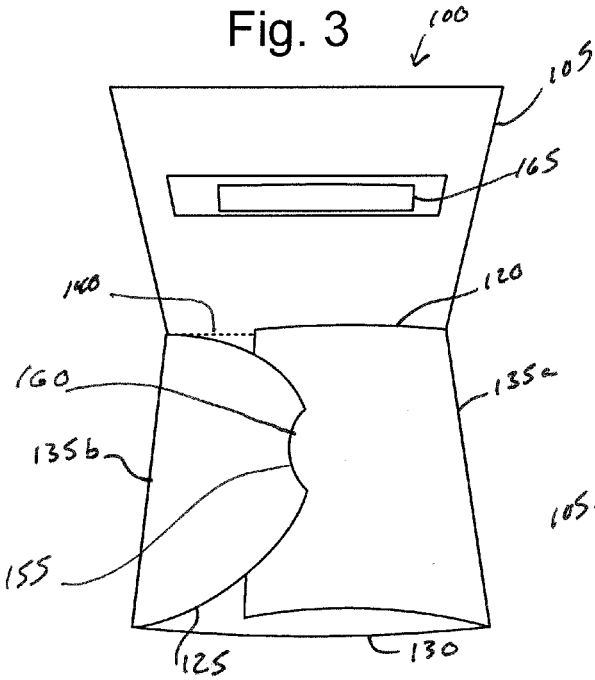
FIG. 3 is a perspective view of a gift card holder showing an attached gift card backer panel attached to the hang tag assembly and lifted away from the main body of the holder.

FIG. 3 is a perspective view of a gift card holder 100 showing the gift card backer panel 105 attached to the hang tag assembly 110 and lifted or tilted away from the main body 115 of the holder 100 by pivoting the hang tag assembly 110 about perforation and fold line 140. Transaction indicia 165, such as a bar code or UPC code may be provided on the underside or rear surface of the backer panel 105 The first cover flap 120 and second cover flap 125 are shown in closed positions with the leading, outward edge of the second cover flap 125 is inserted into a closure slit 155 in the first cover flap 120 in order to retain both flaps 120 and 125 in the closed positions. The closure slit 155 may be formed in an arc so as to create a semi-circular or arc-shaped closure tab 160.

As shown in FIG. 2, the first hang tag panel 112 may include a cut-away or notch 170 to provide means for viewing transaction indicia, such as a bar code or UPC code, or other information, contained on the aligned portion of the surface of the backer panel 105. The notch 170 is shown in FIG. 2 as an alternative element but is omitted from FIG. 4.

Figure 5:
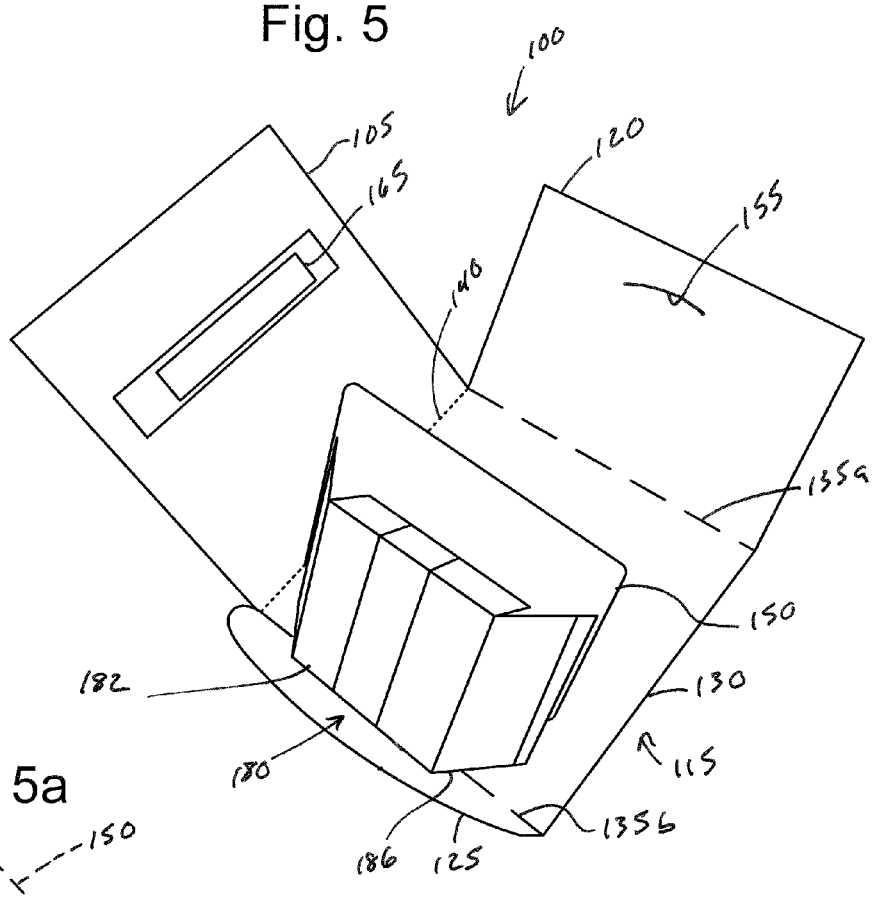
FIG. 5 is a perspective view of a gift card holder showing the gift card backer panel lifted away from the main body of the holder and the first flap and second flap of the gift card holder main body opened to reveal a pop-up element holding a gift card.
Figure 5A:
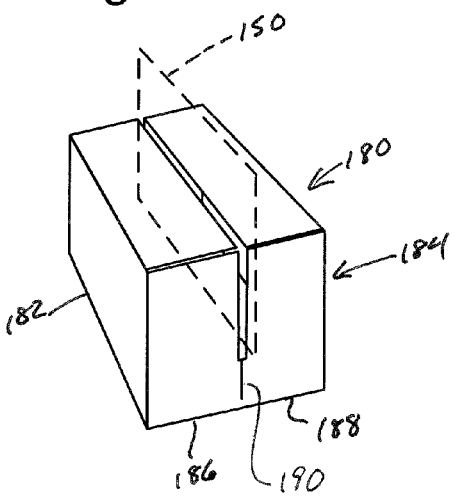
FIG. 5*a* is a diagram in perspective view showing a popup element.

FIG. 5 is a perspective view of a gift card holder 100 showing the backer panel 105 lifted away from the main body 115 of the holder 100 and the first cover flap 120 and second cover flap 125 of the gift card holder main body 115 opened to reveal a pop-up element 180 holding a gift card 150. The pop-up element 180 comprises a front panel 182, back panel (a minor-image structure of the front panel and not shown but the position indicated by reference number 184 in FIG. 5*a*), first and second side panels joining the left edges of the front and back panels, and third 186 and fourth 188 side panels joining the right edges of the front 182 and back 184 panels. The first and second side panels minor the structure and placement of the third and fourth side panels, 186 and 188. The front panel 182 is attached along its lower margin to the inside surface of the second flap 125. The back panel 184 is attached along its lower margin to the inside surface of the center or main panel 130. The pop-up element side panels bridge the space between the front 182 and back 184 panels and swing outward at the fold lines 190 dividing left and right side panels when the second flap 125 is closed against the main panel 130.

Figure 6:
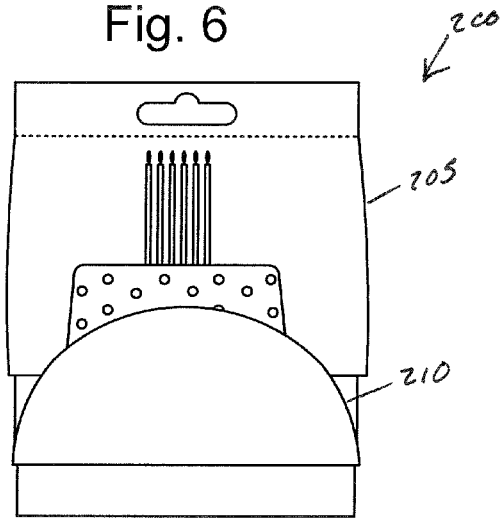
FIG. 6 is a front view of an alternative embodiment of a gift card holder showing the flaps in a closed position.
Figure 7:
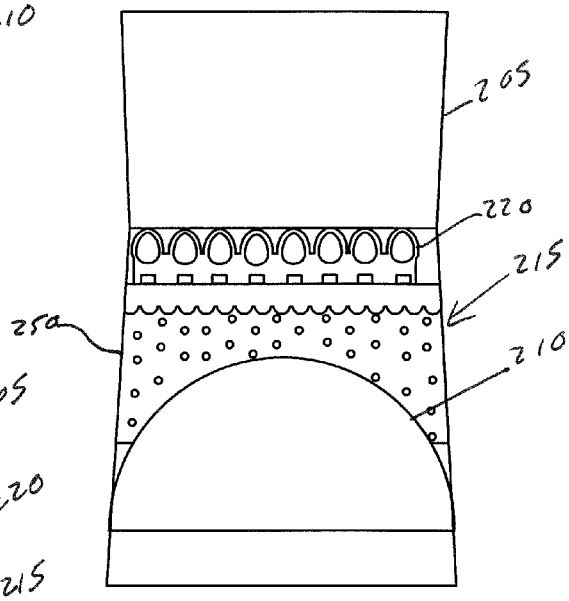
FIG. 7 is a front view of the gift card holder of FIG. 5 showing the first flap in an open position.
Figure 8:
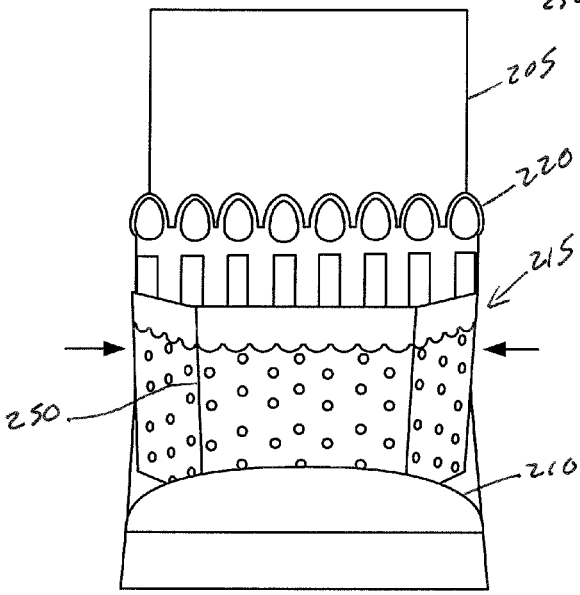
FIG. 8 is a front view of the gift card holder of FIG. 6 showing the first flap in an open position, the second flap in a partially open position and the pop-element extended and holding a gift card.

FIG. 6 is a front view of an alternative embodiment of a gift card holder 200 without an attached backer panel. The first cover flap 205 and second cover flap 210 are shown in a closed position. FIG. 7 is a front view of the gift card holder 20 of FIG. 6 showing the first flap 205 in an open position and the pop-up element 215 in a substantially closed and flattened position as it is when the flaps 205 and 210 are closed. FIG. 8 is a front view of the gift card holder 200 of FIG. 7 showing the first flap 205 in an open position, the second flap 210 in a partially open position and the pop-element 215 partially extended and holding a gift card 220 shaped in a holiday theme. As disclosed, the popup element 215 is designed and configured to resemble and represent a birthday cake and the gift card 220 is designed and configured to resemble and represent birthday candles atop the popup element 215.

Figure 9:
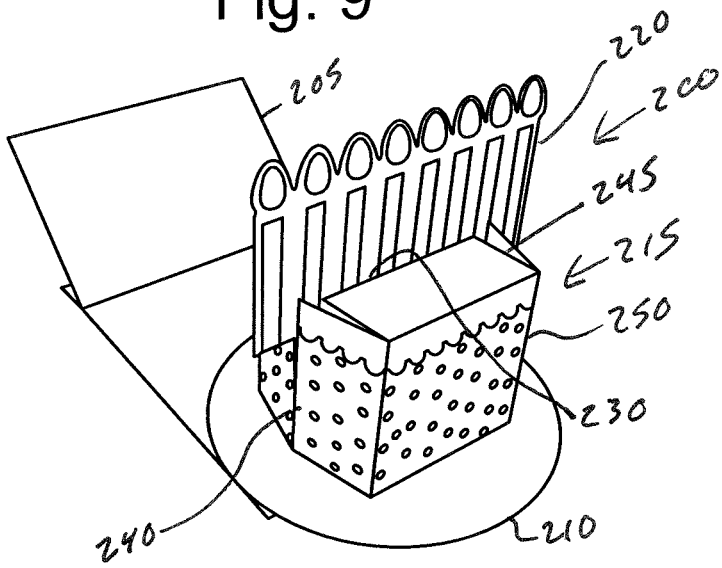
FIG. 9 is a side perspective view of the gift card holder of FIGS. 5-7 showing the pop-up element fully extended.
Figure 10:
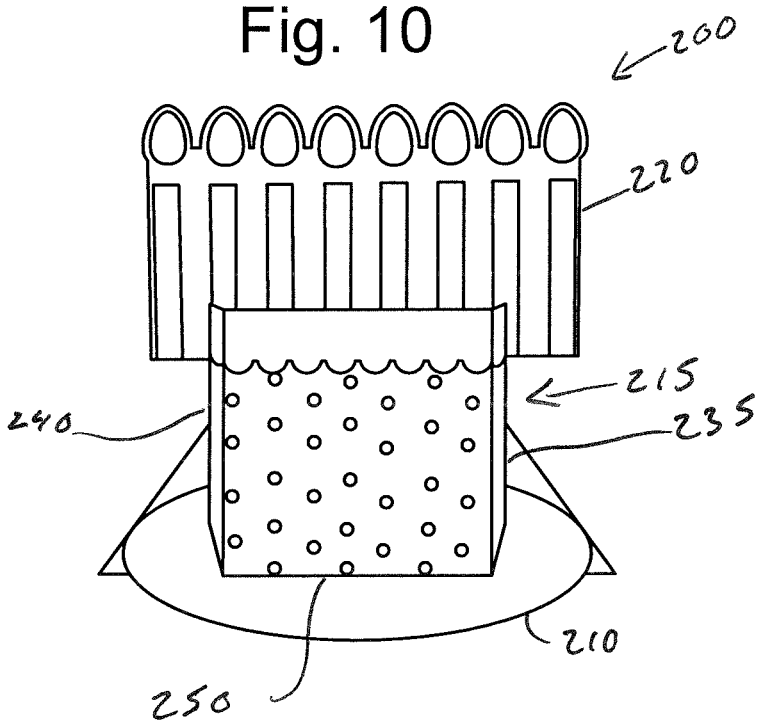
FIG. 10 is a front perspective view of the gift card holder.

FIG. 9 is a side perspective view of the gift card holder 200 of FIGS. 6-8 showing the pop-up element 215 fully extended, the side panels drawn inward and the gift card 220 prominently held within a slot 230 that traverses the pop-up element 215 from a first medial fold line 235 between the first and second side panels to a second medial fold line 240 between the third and fourth side panels. A first top panel 245 of the pop-up element 215 is also shown in this view. The top panel 245 extends rearward from the front panel 250 at a fold line therebetween and terminates at the slot 230. A second top panel (not shown) may also be provided extending forward from the back panel to also terminate at the slot. In such embodiments, the top panels are bisected by the slot 230 and the gift card 220 is retained therebetween. FIG. 10 is a front perspective view of the gift card holder 200 showing the pop-up element 215 fully extended and the gift card 220 held within the slot 230 in a presentation disposition.

Note that drawings are not to scale or to relative scale but are representative of aspects of one or more embodiments of the present invention.

Having thus described the invention, what is claimed as new and desired to be secured by Letters Patent is:

1. A pop-up transaction card holder comprising:
a main body including at least one cover flap,
a popup element positioned underneath said cover flap when the holder is in a closed position, said popup element including a first panel projecting from the inner surface of said cover flap and a second panel projecting from a main panel hingedly connected to said cover flap,
a first side panel extending from said first panel to connect at a first fold line with a second side panel extending from an opposing side of said second panel,
a first slot extending downward along said first fold line,
a third side panel extending from said first panel to connect at a second fold line with a fourth side panel extending from an opposing side of said second panel,
a second slot extending downward along said second fold line, and
said slots sized to receive and hold within a portion each of a transaction card.

2. The transaction card holder of claim 1 further comprising a hang tag assembly extending from said main body.

3. The transaction card holder of claim 2 further comprising a perforation line dividing said hang tag assembly from said main body.

4. The transaction card holder of claim 2 wherein said hang tag assembly includes a transaction card backer panel attached to a hang tag panel of said assembly.

* * * * *